US005376039A

United States Patent [19]

Balgin

[11] Patent Number: 5,376,039

[45] Date of Patent: Dec. 27, 1994

[54] ROPE-SKIPPING TOY

[76] Inventor: Lionel G. Balgin, 63 Central Ave., Albany, N.Y. 12206

[21] Appl. No.: 246,360

[22] Filed: May 19, 1994

[51] Int. Cl.[5] ..... A63H 13/14

[52] U.S. Cl. ..... 446/307; 446/484

[58] Field of Search ..... 446/307, 308, 309, 311, 446/312, 484

[56] References Cited

U.S. PATENT DOCUMENTS

| | | | |
|---|---|---|---|
| 1,594,649 | 8/1926 | Trautmann | 446/307 |
| 3,603,030 | 9/1971 | Bart et al. | 446/307 |
| 3,650,066 | 3/1972 | Amici et al. | 446/307 |
| 3,744,182 | 7/1973 | Terzian et al. | 446/307 |

FOREIGN PATENT DOCUMENTS

| | | | |
|---|---|---|---|
| 481281 | 3/1953 | Italy | 446/307 |

*Primary Examiner*—Mickey Yu

*Attorney, Agent, or Firm*—Schmeiser, Morelle & Watts

[57] ABSTRACT

A motor-driven, rope-jumping doll. The doll features a conventional toy that closely imitates rope-jumping by a human. A battery powered motor is activated and deactivated by lightly pressing on top of the doll's head. Once in motion, the doll appears to swirl the rope overhead and underfoot while effecting a jump each time the rope passes its zenith and nadir. The "timing" jump and the rope-skipping jump, combined with a true swirling motion applied to the rope by principally the "elbows" and "wrists" of the toy sincerely emulate one rope-jumping technique used by human beings. An eccentric, asymmetrically spiraled cam and a biasing spring are used to effect the two-jump characteristic by shuttling a discrete internal mass between a first and a second position, twice for each rotation of the cam.

11 Claims, 3 Drawing Sheets

ROPE-SKIPPING TOY

BACKGROUND OF THE INVENTION

1. Field of the Invention

This invention relates generally to a self-propelled animated toy, a jumping motion of which is realized by a powered translation of an inertial mass contained within the toy. More particularly, a toy, in the form of a doll, is maintained in an upright, standing position and caused to jump upwards while simultaneously swinging a jump rope overhead and underfoot.

2. Discussion of Relevant Art

Self propelled toys are known in the art and several have been invented which, by activation of an internal power source, actuate pendulums, gyros and/or inertial masses that effect some form of periodic motion of the toy. Relative to jumping, or hopping toys, including a number of rope-jumping dolls, the more successful of the genre, according to my searches, can be characterized by three features: (1) a design in which arms are swung overhead, thus completing a 360° swinging motion effected by whole arm rotation; (2) rapid and repeated translation of a spring-biased inertial mass which generally impacts the translating mechanism or utilizes the same as part of the mass; and (3) an aesthetic device which lends some realism to a rope-jumping character in that auxiliary cranking means are used to rotate the rope, giving the impression that the shoulders are merely a partial pivotation point for reciprocative upper arm motion and that the rope is actually being propelled by a swirling action of the hands and forearms. The on-off or actuation mechanism for dolls or toys having the aforesaid features is generally a push button, toggle switch or lanyard located on the back side of the toy, near the base of the toy or in some body (torso) location such that the operation of the mechanism oftentimes can cause the operator's hand to become entangled with the immediately moving rope. This is disadvantageous and it is a deficiency which I have eliminated with my improvement to the toy.

I have also sought to improve the aesthetic qualities of the toy by more correctly emulating the rope-jumping character of a rope-jumping person. Two methods are used when skipping rope, one in which the jumper effects a jogging gait so that each foot, in turn, steps over the traversing rope, and the other in which the jumper effects a minor (timing) jump as the rope passes overhead and a higher, major jump as it traverses underfoot. I have constructed my toy to operate in the double jump mode; and thus, this specific portion of the improvement consists in effecting the minor and major jumps as aforesaid. It also appeared to me deleterious to include in the weight-mass (or inertial mass) any or all of the principal mechanism, including the power supply, of the toy. The staccato rapping of the mechanism against any portion of the body of the toy causes damages, such as loosening, that soon become evident. I, therefore, have chosen to provide an independent weight-mass, actuated by the mechanism, but designed to impact an anvil attached to the body, but held apart from the motivation mechanism and power supply. Finally, I have improved upon the swirling techniques of earlier inventors by employing a mechanism which more closely emulates the whole-arm motions of the jumper. Having set my improved mechanism into the form of a beautiful young child, I feel that I have significantly contributed to the art and hereinafter present the embodiment thereof in detail.

SUMMARY OF THE INVENTION

Principal parts of my rope-jumping doll consists in a head that translates vertically on a shaft fixed to a rigid housing, which is rigidly fixed to two legs so that the doll remains in an upright, straight posture. The feet of the doll are slightly spread apart in order to maintain a wide enough "track" to stabilize the relative to its center of gravity. Further, pedestals each slightly larger than a shoed foot of the doll serve for additional stabilization and as guides to assure that the rope, in its passage underfoot, will not be caught or snagged by portions of the doll's attire. Under the doll's head, as the neck portion contacts the rigid torso framework, I have placed an on-off pushbutton switch. Thus, no matter how fast the rope is driven, even the smallest child can rapidly and safely activate or deactivate the doll by tapping the top of its head. Because of the inherent stability of the doll (I have also placed the weight-mass below its center of gravity), it is not likely to tip, irrespective of whether the turn on-off action is a relatively hard or glancing touch. Inside the housing, are situated a motor, a reduction gear train, a shaft driven by the gear train, an asymmetrical spiral (flat) cam and a pair of coextensive, reflexed cranks which are oriented transversely to the body of the doll and project essentially orthogonally outward from the left and the right sides. Both the cam and the crank assembly are mounted on a common shaft, taking power from the gear train. Immediately outside the body is the battery power assembly. Within the body, but detached from and distinct from the motor and drive mechanism, is a weight-mass that is spring-biased and oriented to translate reciprocatively in the vertical direction. Full expansion of the biasing spring causes the weight-mass to contact an anvil assembly which is rigidly fixed to the housing of the doll. Securely fixed to the top of the weight-mass, but aside from the contact point with the anvil, is a roller assembly which is in contact with most of the cam surfaces and is responsive to the rotating contact of the cam. Camming (angular) action is thereby translated into a reciprocative linear motion by virtue of the weight-mass confinement to only vertical translation and the camps design which effects a dual camming and nulling action for each 360° rotation of the cam and, via the common shaft, crank assembly. A jump rope is tethered, each end at the ends of the crank assembly. Of the jumprope, only the underfoot portion is flexible, being connected at approximately foot height to a rigid strand or wire; the remaining ends thereof are each securely fixed at the left and right hand ends of the crank assembly. When the doll mechanism is actuated by a slight tap on the doll's head, crank and cam rotate simultaneously and the latter twice impels the weight-mass downward for each 360° rotation of the former. Because of the asymmetry of the spiral flat cam, the weight-mass traverses a shorter distance as the crank driven rope passes overhead and a longer distance as the same crank driven rope approaches the pedestals. The effect is that the doll executes a short "hop" as the rope passes overhead and a much higher "jump" as the rope passes underfoot. Rounding out this aesthetic quality of operation, I have provided on structures which consist of a flexible wire mechanism securely fixed at each "shoulder" socket of the doll and having angularly flexible "elbows", relatively stiff forearms attached thereto and crank end encircling (but not fixing or gripping) hands. Thus, as the crank assembly rotates, the "arms" of the doll appear to be swirling the rope by essentially forearm and hand action, while each "upper arm" effects only a slight pendulous action. This effect is realized primarily because of the rigid fixation of flexible wire arm members at the shoulder portions of the torso and angular flexibility at the elbows that is afforded by small coils in the flexible wire element.

DETAILED DESCRIPTION OF THE PREFERRED EMBODIMENT

I have provided a series of drawings which are detailed enough to assemble the invention. During the discussion, I will pay special attention to just my improvements and the mechanisms used to realize those improvements. Since these are, for the most part, assembly drawings and such assembly uses techniques and apparatus that are known in the art, I will not dwell on the position and types of elements that are quite common-place and known to those having skill in the art.

Figure 1:
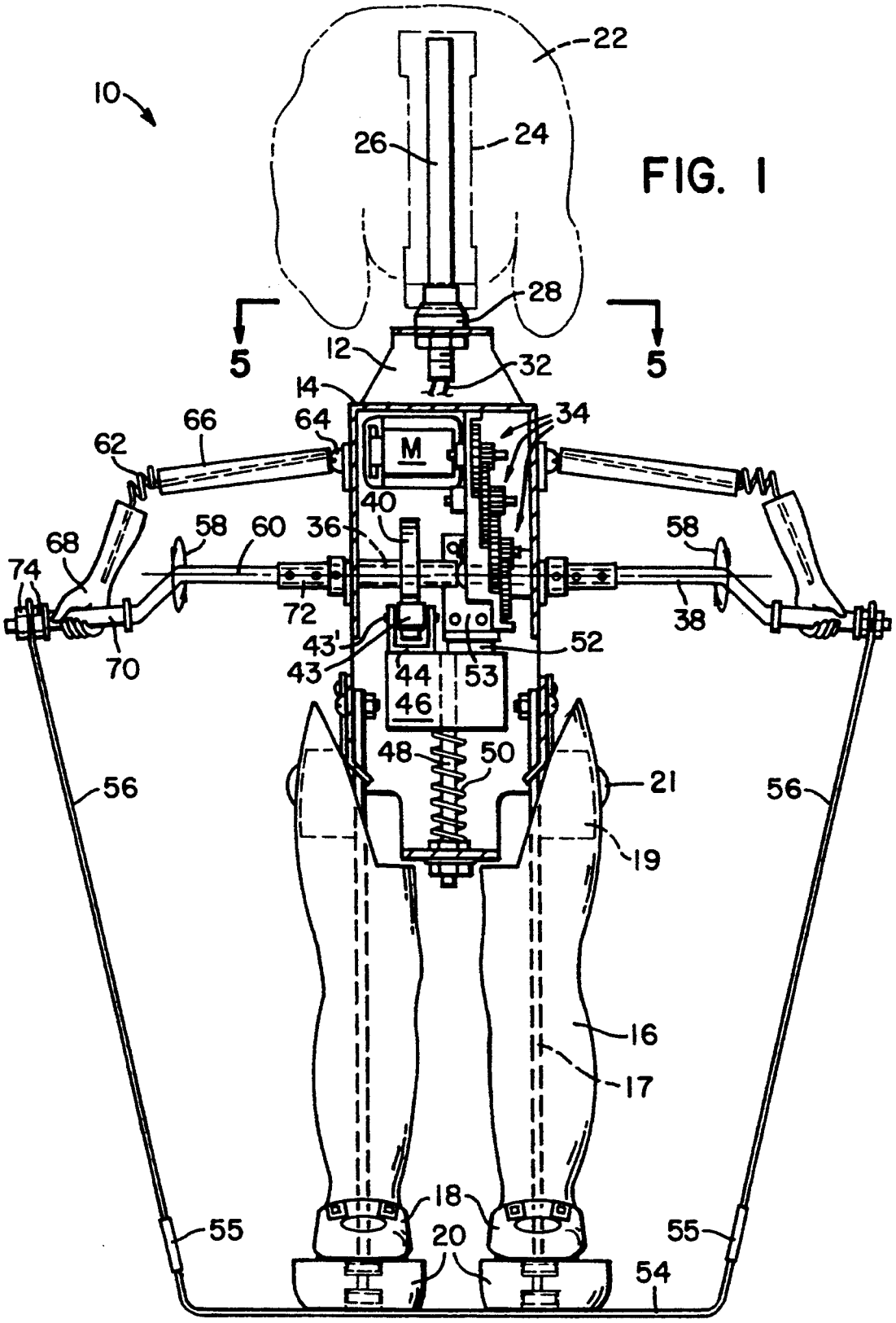
FIG. 1 is a partially sectioned frontal elevation of my invention.

Referring now specifically to FIG. 1, the invention improvement 10 is depicted in partially sectionalized frontal elevation and consists principally in a torso or body housing 12 which partially encloses a drive mechanism case 14, all of which are attached for upright support on struts 17 enclosed in legs 16, the feet of which are enclosed in shoes 18 that appear to be securely fixed to pedestals 20, but which are, in reality, secured to the bottom ends of struts 17. The legs 16 are actually secured to thigh flanges 19 by rivets 21. A doll head 22 has secured therein a sliding segment 24 which provides both a track channel for mounting the head on a vertical track and a flattened base portion for making contact with a switch. The sliding segment 24 will be discussed further at FIG. 3. The head 22 normally resides atop the frame 12 and is transfixed on track 26 via the sliding segment 24 internal channel 25 (not shown). It can readily be seen, from the phantom outline of segment 24, that depression of the head downward will actuate switch 28 which is securely fixed to the uppermost horizontal flange of the frame 12. Immediately beneath the upper frame flange, wires 32 are seen depending from the switch. Routing of these wires is more clearly detailed in FIG. 2. Within the case 13 proper, is motor M, a series of reduction gears 34, main shaft 36 which is used as a power take-off from the last gear of the train 34, a crank assembly 38 projecting transversely from the mid-torso of the doll (i.e. mid-frame 12) and an asymmetrical spiral flat cam 40. By the aforementioned mechanism, the reader is able to see how the motor M drives the crank 38 in a revolution 58 that is common to both it and the cam 40. Since the cam 40 is a double armed spiral, having two null points, it effects a minor cycle corresponding to the smaller of the asymmetrical arms, and a major cycle corresponding to the larger of the arms. Thus, the cam will execute two cycles for every one 360° cycle executed by the crank.

Outside of the case 14, but still within the frame 12, there is situated a weight-mass 46 slidingly disposed on a vertical bar 48 that is fixedly secured to the lowermost flange of the frame 12. The mass 46 is spring-48 biased in an upward position so that it normally rests in abutment with pad 52 that is attached to anvil assembly 53. The anvil assembly 53 is an L-shaped bracket that is securely fixed (generally riveted) to the frame 12. Again, careful attention to the detail of these drawings will allow the reader to discern the specific methods that I have chosen for connecting the various elements. Continuing with the details of the weight-mass 46, there is secured on the top side thereof a roller bracket 44 on which is mounted roller 43 by means of roller (bearing) pin 43'. As the cam 40 rotates, its spiral arms contact the roller 43 urging the mass 46 downward and, when the null portions of the cam are reached and the urging is abruptly discontinued, coil spring 50 drives the mass upward into contact with anvil assembly 53. Pad 52 dampens the sound but provides only modest elastic contact with a mass. For all practical purposes, the anvil assembly 53 transmits the inertial force to the frame 12; the toy reacts accordingly and "jumps" upward twice for every rotation 58 of crank 38. Before departing from the description of the crank assembly proper, the reader may observe that I have connected the left and right cranks 38 to the main shaft 36 via a sleeve and set-screw assembly 72. At the crank ends, there is situate a free rotatable sleeve 70 about which the doll's hand 68 is disposed. This gives the doll's hand a "pivotation" aspect which allows it, in part, to emulate a human swirling motion. Securely fixed to the ends of the cranks by clamping nuts 74, so that there will be no pivotation of its ends, is a stiffened wire 56 which is joined to its counterpart (in a continuous half loop) with a flexible cord portion 54 by connectors 55. I have used very light tubular connectors that allow connection of the jump rope segments (56, 54) by merely pinching the ends of the segments inside the connectors. Thus, as crank 38 is rotated about its axis 60, the end portions complete a 360° revolution 58 while the flexible rope portion 54 does likewise.

The aesthetics of a true swirling motion are mechanized by connecting each hand-forearm unit 68 to the doll's "shoulder" points via a flexible wire 62. The wire is firmly fixed in the hand-forearm unit 68 and rigidly secured 64 at a "shoulder" portion of frame 12. The wire 62 is further wound into a helical coil proximate a half way point between the shoulder connection 64 and the rotatable sleeve 70 about which the doll's hand is gripped. Although not precisely imitative of the human shoulder-elbow-wrist complex when urged by the revolutionary motion of the crank, the hand-forearm unit 68 will emulate, to a significant degree, the swirling motion of a rope jumper because, kinematically, most of that motion is effected by the elbow and wrist of the jumper.

Figure 2:
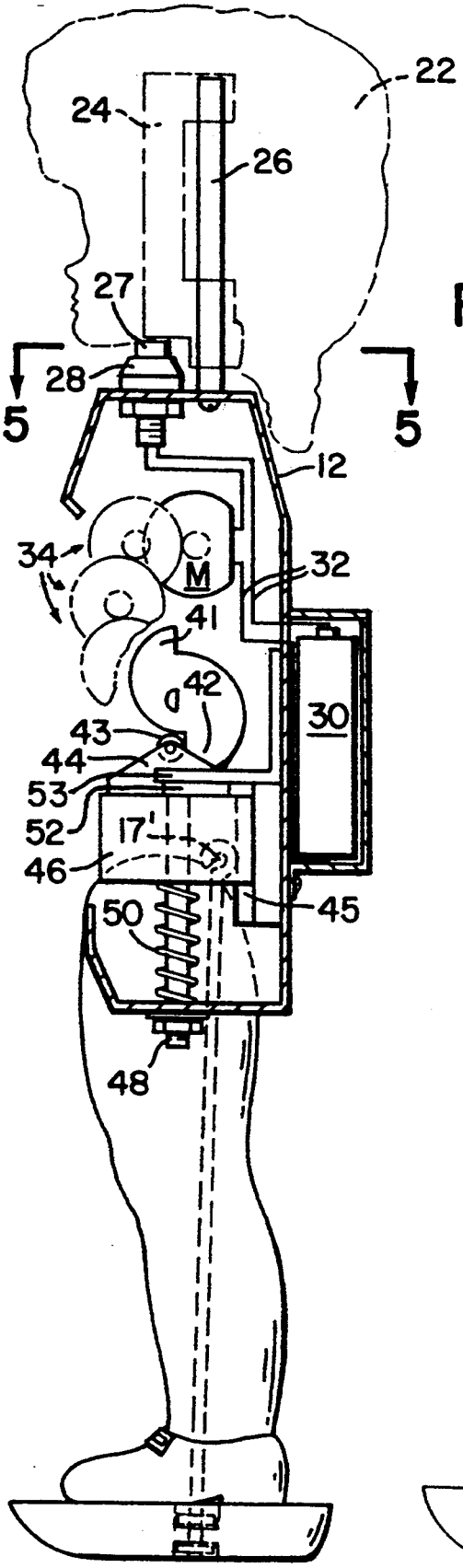
FIG. 2 is a partially sectioned side elevation of my invention.
Figure 3:
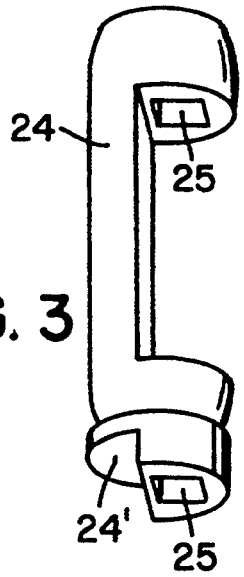
FIG. 3 is a isometric illustration of the head slide segment.
Figure 4:
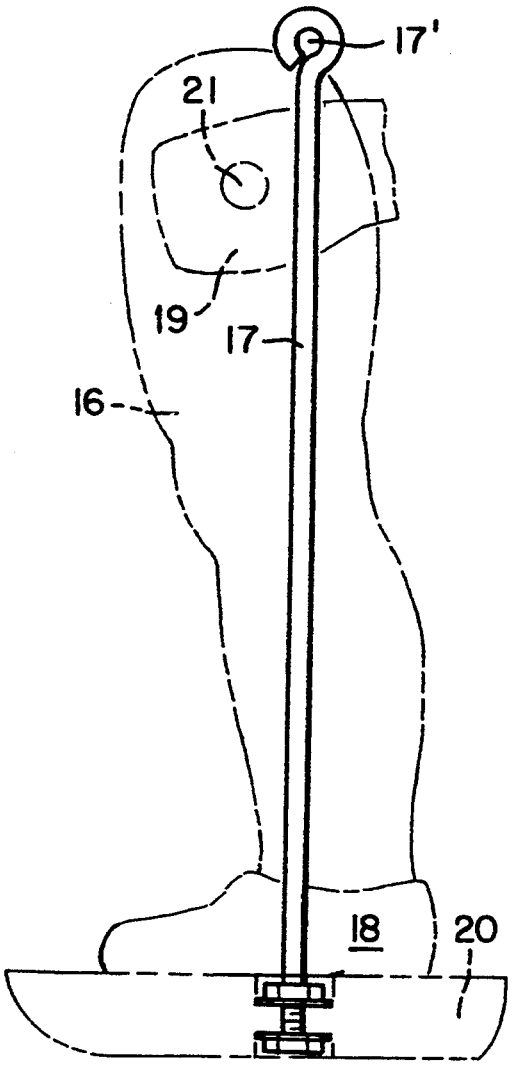
FIG. 4 is a side elevational view of a leg attachment apparatus.

FIG. 2 allows, through partial sectionalization of a side elevation better understanding of the working relationship that exists between the motor, gear train 34 (partially cut away) and the cam 40 as it actuates weight-mass 46 by alternately contacting and releasing roller 43 of roller mechanism 44. As the cam rotates in the direction indicated, the minor arm 41 will first contact roller 43 and the eccentric relationship between the center and the circumferential surfaces of the arms (41, 42) will urge roller 43, and consequently weight-mass 46, downward for approximately 180°, abruptly release it so that biasing spring 50 will drive it against anvil assembly 53 and, as the major arm 42 begins to contact the roller, it will be urged a further distance downward. Thus, at the two null points on the cam, the weight-mass will be released and biased into the anvil, thus effecting two jumps of differing intensities for every rotation of the main shaft 36 (not shown). Also evident in FIG. 2 is the positioning of the battery pack 30 and the wires 32 which connect the batteries to the motor via switch 28. FIG. 3 depicts an orthographic illustration of sliding segment 24 which is secured in vertical orientation inside the head 22. Channel 25 allows mounting of the segment on rail 26 while the base portion 24' is flattened so as to make better contact with the push-button 27 of on/off switch 28. FIG. 4 is a detail of the strut 17 mechanism used for securely fixing the pedestals 20 to the frame 12. As in FIG. 2, the strut is connected by a screw, bolt or rivet in eyelet 17' through lower flanges of the frame 12. Also mounted to the frame 12 are thigh brackets 19. To these are riveted 21 the legs 16 of the doll.

Figure 5:
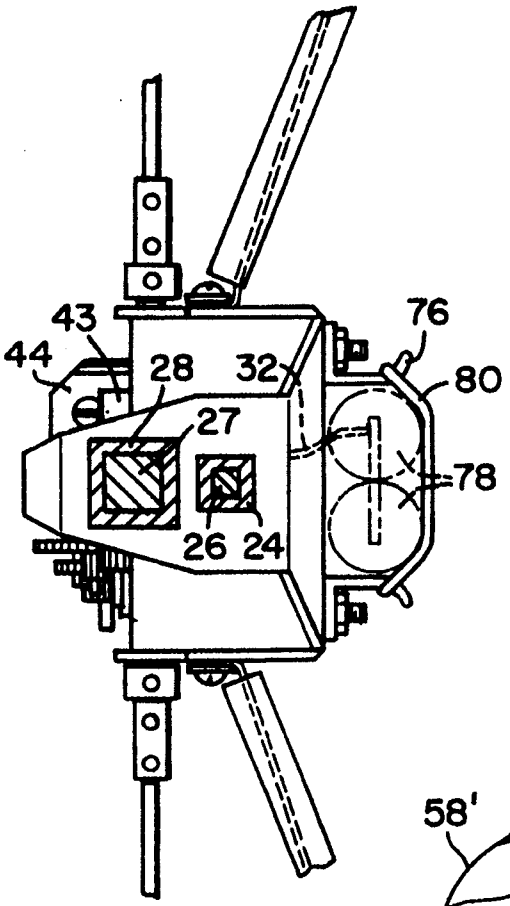
FIG. 5 is a sectionalized top plan taken at 5—5 of FIGS. 1 and 2.

FIG. 5 is a top plan of the invention as seen from 5—5 of FIGS. 1 and 2. Most of the apparata depicted have been previously discussed but greater attention is paid to the batteries 78 mounted in battery bracket framework 76 and secured by elastic band 80.

Figure 6:
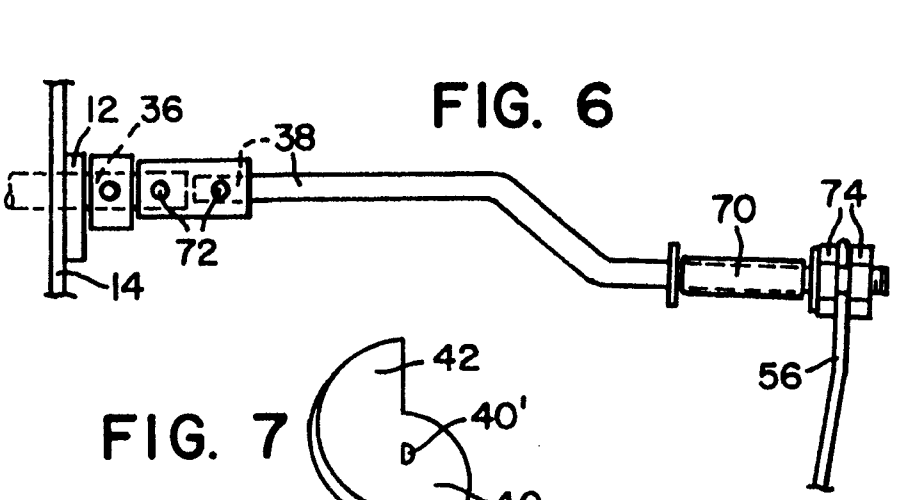
FIG. 6 is an isometric illustration of the left hand crank assembly.
Figure 7:
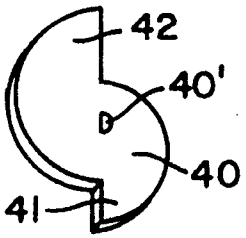
FIG. 7 is an isometric illustration of the asymmetrical spiral cam.

Details of the crank and cam are shown in FIGS. 6 and 7, respectively. Relative to the rope 56 capture at the end of a crank 38, the reader may note that I have simply inserted an end thereof through a hole at the end of the crank and secured it fixedly by use of (compressing) adjacent nuts 74. This was done by threading and drilling a small portion at the ends of each crank. Likewise, the reader may discern my means for attaching crank 38 to main shaft 36 by sleeve and set-screw assembly 72. In FIG. 7, an isometric illustration of the cam 40 clearly shows the central mounting point 40' and the eccentric, and asymmetrical arms 41, 42 of the cam.

Figure 8:
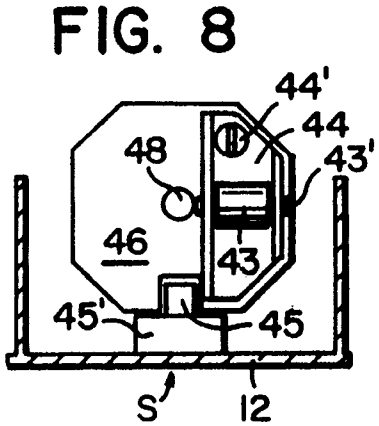
FIG. 8 is a top plan of the weight-mass and roller assembly.

FIG. 8 is a plan view of the weight-mass 46 assembly. The mass 46 slides up and down on bar 48 while it is guided, and prevented from rotating, by a vertical rail 45 that is part of a guide bracket 45' secured S to frame 12. I often refer to the weight-mass as a hammer and thus, the nomenclature "hammer and anvil" should be familiar to the reader as the impact or "jump" forming mechanism of the toy. Final to FIG. 8, roller bracket 44, bearing 43' and roller 43 are rigidly secured to the weight-mass (hammer) 46 by bolt 44'.

Figure 9:
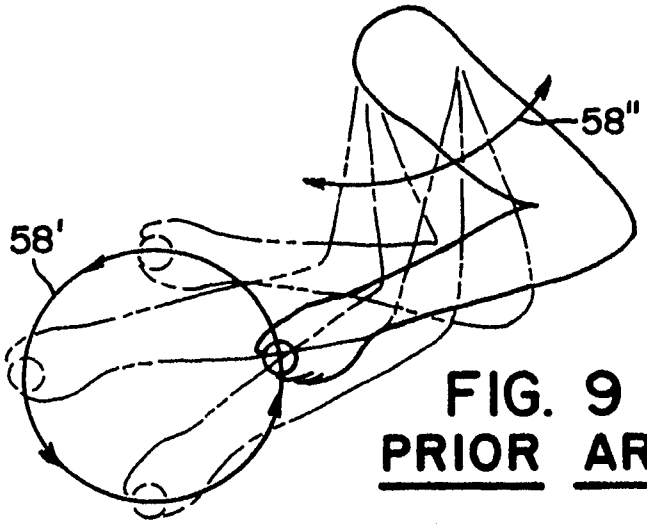
FIG. 9 PRIOR ART
FIG. 9 is a kinematic of the prior art.

FIG. 9 is an illustration of how one example of the prior art effects a "swirling" motion of the rope. The revolution 58' of a crank is practically identical to that which I acquire by my improvement; however, the exaggerated pendulous motion 58'' of the figure's upper arm, whether clothed (as is mine) or unclothed, have been ameliorated by my rigid shoulder, flexible elbow design.

Although the improvement that I have made in rope-jumping doll art has been detailed rather specifically, I do not intend such to be read as a limitation. Much of the assembly and attachment apparatus may be varied; as well as the embodiment used to capture certain qualities such as the double jump or flexible elbow swirling emulation, without departing from the spirit of the invention. Further improvements and revisions are therefore commended to the field consistent with the hereinafter appended claims.

What is claimed is:

1. In a motor-driven, rope-jumping toy that features a bi-pedal supported torso with a head and moveable arm pair, and includes a jump rope, an improvement thereto comprising the combination of:

motor activation-deactivation means disposed beneath said head and responsive to tactile force applied to said head;

swirl-emulation means for continuously effecting a forearm 360° swirling motion and a concomitant upper arm pendulous motion that are imitative of human arm motions during rope jumping activity; and motivation means for causing staccato upward jumps of said torso in a ratio of two discrete jumps for every said 360° swirling motion.

2. The toy of claim 1 wherein said motor activation-deactivation means comprises a switch mechanism that is moved alternately to on and off positions when an operator presses said head downward and releases it.

3. The toy of claim 2 wherein said swirl-emulation means comprises:

a motor driven elongate crank movably disposed transverse to said torso and having reflexed ends which effect a 360° locus when said crank rotates; and a flexible arm pair suspended by torsion means, each arm thereof differentiated into an upper arm fixedly connected to a shoulder of said torso, said upper arm torsionally connected to a forearm for angular flexation thereof and the end of said forearm pivotally joined to one end of said crank, whereby as said crank rotates, said end of said forearm effects a 360° rotation and torsional force is transmitted to said upper arm rocking it in a pendulous motion.

4. The toy of claim 2 wherein said motivation means comprises:

A gear train;

a motor, responsive to power supplied through said switch mechanism for powering said gear train which rotates said swirl-emulation means through at least one 360° rotation while concurrently rotating a cam that is fixedly disposed on said swirl-emulation means;

said cam of an asymmetrical, spiral form which is used to convert uniform rotary motion to irregular reciprocative motion; and a spring-biased, reciprocative hammer mounted in opposition to an anvil, said hammer disposed proximate a lower portion of said torso with said anvil superposedly disposed likewise for a spring-extended contact by the said hammer, said hammer having on top thereof a roller detent which accepts machinations of said cam, whereby as said swirl-emulation means is driven through said at least one 360° rotation, said cam effects a dual reciprocation of said hammer which thereby twice impacts said anvil.

5. A motor-driven, rope-jumping device of a conventional rope swirling doll configuration comprising:

a torso having thereon a head and supported by a fixed leg pair, said torso containing therein a motor, a gear train that transfers power from said motor via a common shaft to a spiral cam means and to a transversely mounted rotating crank that terminates in a rope-holding hand at each end, a fixed anvil means and a moveable hammer means, said hammer means responsive to both camming motion of said cam means and a biasing spring to alternately shuttle between a first position and second position relative to said torso section; and, motor on/off switching means for applying/removing power continuity between said motor and a power source, said switching means responsive to tactile force applied to said head.

6. The device of claim 5 wherein said spiral cam means is a rotatable, asymmetrical spiral cam for forceably shuttling said hammer means, whereby said cam converts each 360° rotation thereof to a first and an immediate second linear translation of said hammer means.

7. The device of claim 6 wherein said hammer means is a spring-biased weight-mass which has mounted thereon a roller detent mechanism that is contacted by said spiral cam.

8. The device of claim 7 wherein said switching means is a push-on/push-off electrical switch that is disposed atop said torso in proximate contact with said head so that tactile depression of the head provides a push on said switch.

9. An improvement in a rigidly upright standing doll, having a torso, a moveable head and which is motivated to emulate rope jumping by continuously swirling a rope, each end thereof captured in a hand, overhead and underfoot while jumping upward to allow passage of said rope underfoot, said improvement comprising in combination:

a drive mechanism for effecting a 360° swirling motion of the rope ends while concurrent therewith causing said doll to effect two discrete upward jumps in response to reciprocations of an internal weight-mass; and on/off switching means located proximate to said head and responsive to tactile force thereon for activating/deactivating said drive mechanism.

10. The improvement of claim 9 wherein said drive mechanism comprises:

a gear train;

a motor responsive to power supplied through said switching means for powering said gear train;

a shaft having thereon a crank mechanism and an eccentrically disposed, asymmetrically spiraled cam and which is responsive to machinations of said gear trains.

11. The improvement of claim 9 wherein said on/off switching means comprises a push-on/push-off electrical switch that is disposed atop said torso in proximate contact with said head, whereby tactile depression of the head provides a push on said switch.

* * * * *